United States Patent [19]

Fudro

[11] 4,185,389

[45] Jan. 29, 1980

[54] EGG DECORATING DEVICE

[76] Inventor: Stanley J. Fudro, 2322 Second St. NE., Minneapolis, Minn. 55418

[21] Appl. No.: 889,917

[22] Filed: Mar. 24, 1978

[51] Int. Cl.[2] ..... B43L 13/00

[52] U.S. Cl. ..... 33/21 R

[58] Field of Search ..... 118/500, 503, 219; 33/21 R, 21 D, 21 C, 27 L

[56] References Cited

U.S. PATENT DOCUMENTS

| | | | |
|---|---|---|---|
| 134,498 | 12/1872 | Von Hofe | 33/21 D |
| 236,432 | 1/1881 | Higbee | 33/21 D |
| 3,110,107 | 11/1963 | Wilhelm | 33/21 R |
| 3,358,644 | 12/1967 | Greene | 118/503 X |
| 3,484,797 | 12/1969 | Barnett et al. | 33/21 D |
| 3,792,163 | 2/1974 | Fudro | 33/21 D |
| 3,988,834 | 11/1976 | Anderson | 33/21 R |

FOREIGN PATENT DOCUMENTS

| | | | |
|---|---|---|---|
| 611896 | 7/1926 | France | 33/21 D |
| 654337 | 6/1951 | United Kingdom | 33/21 D |

*Primary Examiner*—Harry N. Haroian

*Attorney, Agent, or Firm*—Merchant, Gould, Smith, Edell, Welter & Schmidt

[57] ABSTRACT

Apparatus for decorating eggs and the like. The apparatus includes a support for rotating an egg about its longitudinal axis and an arm member for carrying a marker and mounted for marking movement longitudinally of the egg. Coordinated rotation of the egg and manipulation of the arm member result in creating a decorative marking on the egg.

15 Claims, 6 Drawing Figures

EGG DECORATING DEVICE

The invention generally relates to egg decorating devices, and is specifically directed to such a device in which the egg is held for manual rotation about its longitudinal axis relative to a marker.

The egg decorating device herein disclosed and claimed represents an improvement and variation on the egg decorating device shown in my U.S. Pat. No. 3,792,163, which issued on Feb. 12, 1974. In this earlier patent, an egg can be held between first and second standards mounted to a common base for manual rotation. A primary arm member of U-shaped configuration is pivotally mounted to the base with the outer legs of the U disposed on opposite sides of the egg, one of which serves as a handle. The axis of rotation of the U-shaped arm member is spaced from and transverse to the egg longitudinal axis.

The other upstanding leg of the U-shaped member pivotally carries a secondary arm member. The extreme end of the secondary arm member is adapted to carry a marker which overlies the egg, and is normally biased into engagement with the egg by a rubber band acting between the primary and secondary arm members. Thus, a variation of patterns can be made by the marker on the egg surface by separate or simultaneous manual rotation of the egg and swinging movement of the primary arm member.

This invention also makes use of first and second upright standards which are commonly mounted on a base plate. Each of the standards carries a cup-shaped member which are disposed in opposition to receive an egg therebetween. One of the cup-shaped members is resiliently retractable along the axis of egg rotation to permit entry of the egg.

A track is supported by but elevated from the base plate. The track is disposed in general alignment with the rotational axis of the cup-shaped members (i.e., the egg axis), and is spaced from this axis so that it lies adjacent an egg carried between the cup-shaped members.

A track-following member is slidably disposed on the track. An arm is pivotally mounted to the track-following member for swinging movement toward and away from an egg. The extreme end of the arm is constructed to receivably carry a marking device such as a felt tip pen. The arm is normally urged toward the egg by a suitable biasing means acting between the arm and the track-following member.

With an egg properly mounted between the cup-shaped members and a marking device inserted into the carrying arm, the egg may be artistically decorated by manually rotating the egg and moving the track-following member along the track, which causes the marking device to engage and mark the egg while following its contour. These operations may be separate or simultaneous to effect an endless variation of patterns and configurations on the egg surface.

In the preferred embodiment, each of the standards takes the form of a standing rabbit, the fore paws of which hold one of the cup-shaped members. The rabbit structures are decorated with stick-on clothing, or, alternatively, include depression lines and shapes which can be marked to represent the rabbit features, clothing and the like.

In the preferred embodiment, each of the upright standards and track support is releasably mounted so that the unit may be disassembled with not in use. Further, the base plate, upright standards and track support are generally flat, and upon disassembly offer a compact package for storage purposes.

DESCRIPTION OF THE PREFERRED EMBODIMENTS

Figure 1:
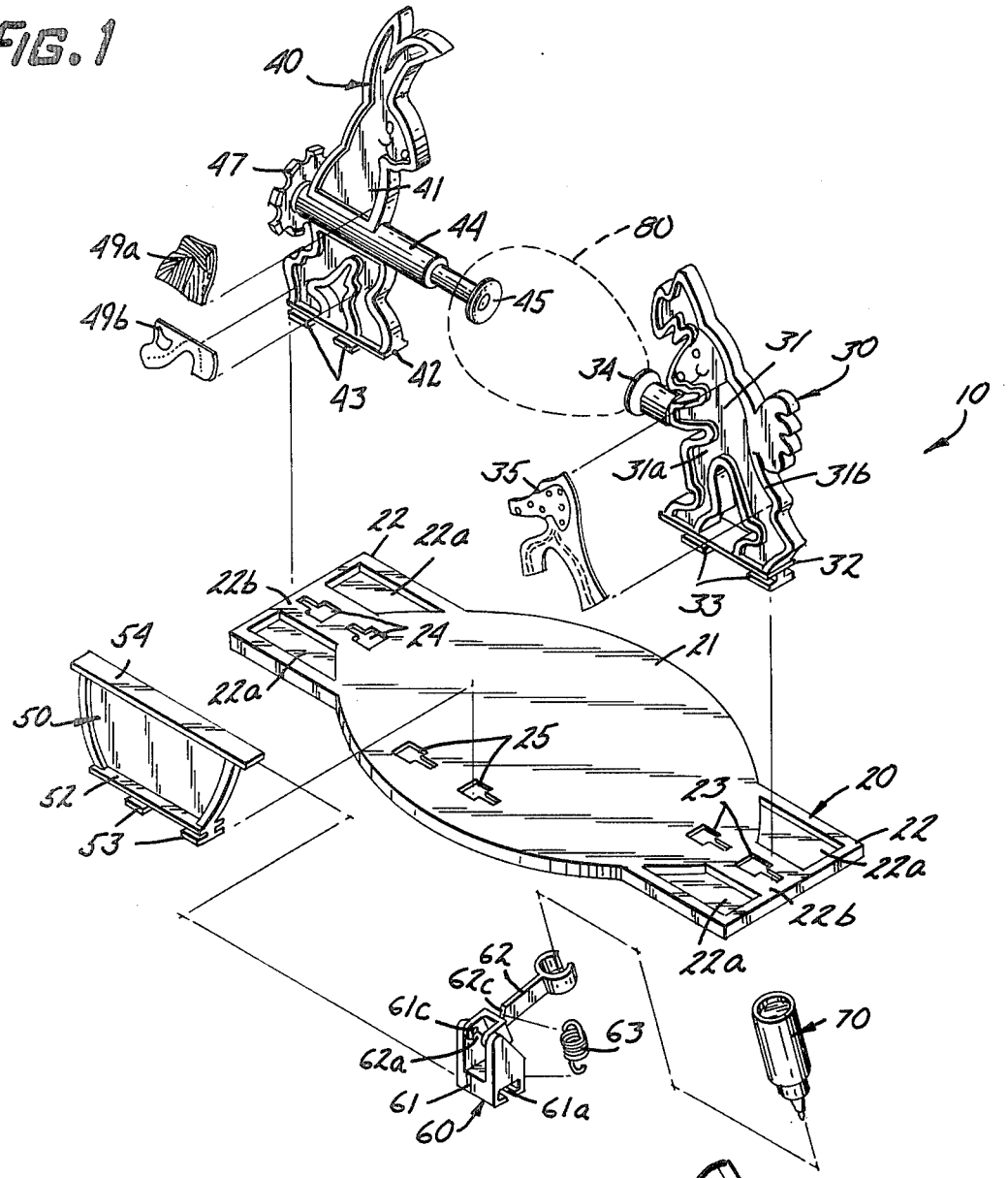
FIG. 1 is an exploded perspective view of an egg decorating device embodying the invention and showing an egg in the decorating position.

With initial reference to FIGS. 1–4, an egg decorating device embodying the invention is represented generally by the numeral 10. Egg decorating device 10 comprises a base plate 20 on which upright standards 30, 40 are releasably mounted in opposed relation. A track member 50 is also releasably mounted on the base plate 20 in an upright position laterally adjacent the standards 30, 40. A track-following member 60 constructed to carry an egg marking device 70 is slidably mounted on the track member 50.

Figure 2:
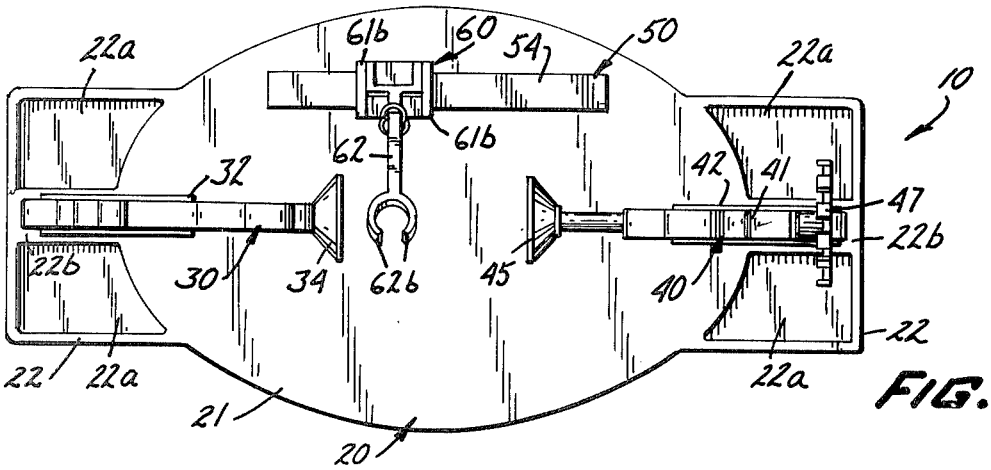
FIG. 2 is a view in top plan of the egg decorating device.

The base plate 20 is flat, and as best shown in the top plan of FIG. 2, takes the form of a symmetrical egg 21 with rectangular projections 22 extending longitudinally from each end. Irregular recesses **22*a* are formed in each projection 22, leaving a central region 22*b* which is coplanar with the egg 21**.

A first set of bayonet openings 23 are formed in one end of the base plate 20 on its longitudinal axis to receive the upright standard 30, as will be described below. A second set of bayonet openings 24 are disposed at the opposite end of the base plate 20, also on its longitudinal axis. A third pair of bayonet openings 25 are formed in the base plate 20 laterally adjacent its longitudinal axis but centrally disposed relative to the base plate ends.

Upright standard 30 comprises a rabbit body 31 which in the preferred embodiment includes a central region **31*a* of a first thickness and a peripheral rim 31*b* of greater thickness for strengthening as well as aesthetic purposes, which will be discussed below. As shown in FIG. 1, the rabbit 31** may be formed with facial features.

The body 31 is integrally formed with a flat base member 32. A pair of bayonet connectors 33 of inverted T configuration project downwardly from base member 32. The connectors 33 are spaced and sized to fit into the openings 23 in mounting relation.

Figure 3:
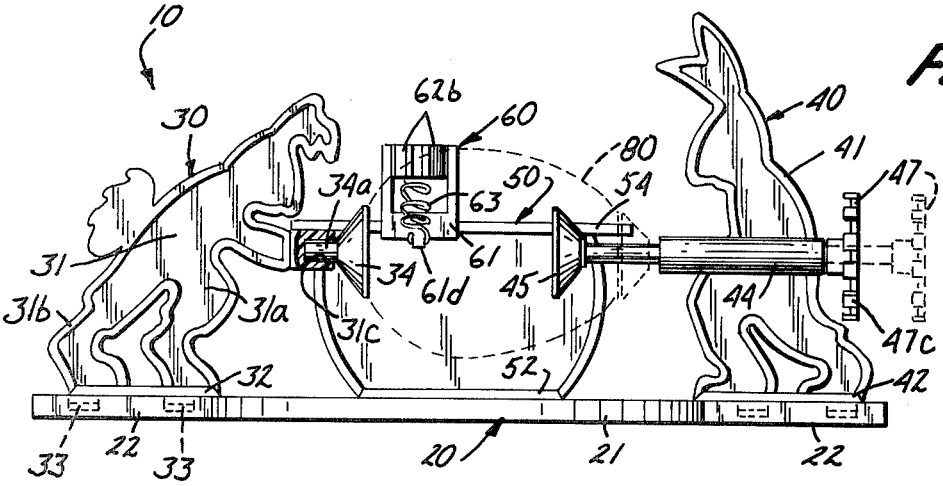
FIG. 3 is a view in side elevation of the egg decorating device with the egg holding means in a first position without an egg and in the second position with an egg in place.

With specific reference to FIG. 3, the rabbit forepaws terminate in a forwardly opening recess or socket **31*c*. A first cup-shaped member 34** has a rearwardly extending short stem 34*a* which is received in the socket 31*c* for rotation relative to the rabbit body 31 about a predetermined axis.

The upright standard 40 is similar in construction to standard 30, although having a slightly different configuration depicting a different rabbit 41 in a different position. The rabbit body 41 is integrally formed with a similar base member 42 and includes downwardly projecting bayonet connectors 43 sized and disposed for releasable mounting in the bayonet openings 24.

Figure 5:
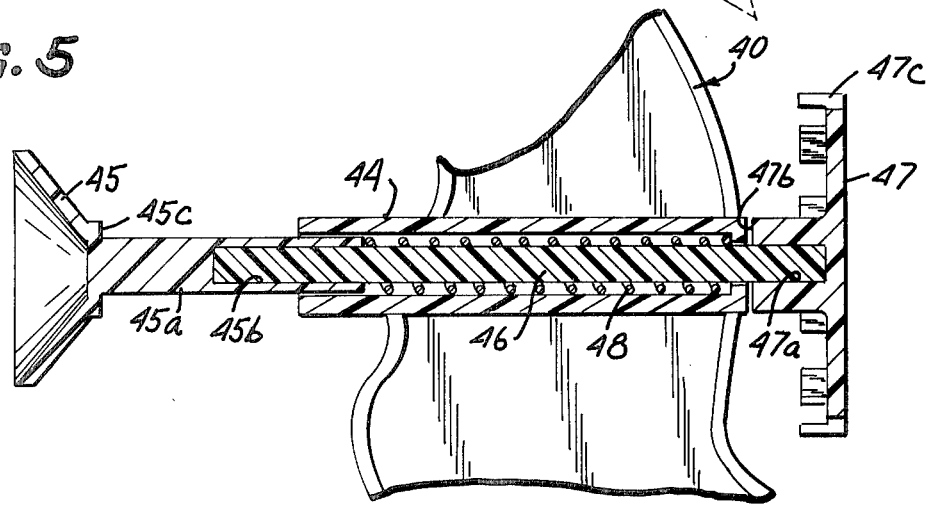
FIG. 5 is an enlarged fragmentary sectional view of one of the upright standards, showing with particularity the retractable structure for holding an egg in the decorating position.

With specific reference to FIGS. 3 and 5, the rabbit body 41 is formed with a stationary, horizontally disposed tubular member 44 which projects forwardly to depict the rabbit forepaws. A second cup-shaped member 45 has a rearwardly extending stem 45*a* in which an axial bore 45*b* is formed. The outside diameter of the stem 45*a* is slightly smaller than the inside diameter of tubular member 44, permitting relative sliding movement therebetween.

An elongated thin shaft 46 has one end inserted into the axial bore 45*b*. The shaft 46 extends entirely through the tubular member 44, and its opposite end projects beyond the rabbit body 41. A handle wheel 47 having an axial bore 47*a* receives the end of the shaft 46 and is connected in a manner that prevents relative rotation therebetween. The shaft 46 and stem 45*a* are similarly connected, so that rotation of the handle wheel 47 causes rotation of the cup-shaped member 45.

A spring 48 is disposed in compression between the end of tubular member 44 and the end of stem 45*a*, thus normally urging the cup-shaped member 45 to the left. The limits of extending and retracting movement of the cup-shaped member 45 are determined by a transverse stop surface 45*c* on the cup-shaped member 45, and a similar stop surface 47*b* on the handle wheel 47. The limit positions of the cup-shaped member 45 and handle wheel 47 are shown in FIG. 3.

As shown in FIGS. 2–5, the handle wheel 47 is formed with twelve equiangularly spaced tabs 47*c* which permit the cup-shaped member 45 to be angularly oriented at 30° intervals with some degree of accuracy.

With reference to FIGS. 2 and 3, it will be observed that the cup-shaped members 34, 45 rotate about a common axis, and the cup-shaped member 45 is retractable along the same axis. As such, and with particular reference to FIG. 3, an egg 80 may be inserted into the device 10 by retracting the handle wheel 47 and positioning the egg ends in the respective cup-shaped members 34, 45. Release of the handle wheel 47 enables the spring 48 to urge the cup-shaped member 45 into clamping engagement with the egg 80. The egg 80 can thereafter be rotated about its longitudinal axis by rotation of the handle wheel 47. The inner surfaces of the cup-shaped members 34, 45 may be coated with a frictional substance to insure that the egg 80 moves with the handle wheel 47.

With reference to FIGS. 1–4, track member 50 comprises an upright support 51 of construction similar to that of the rabbit bodies 31, 41 and taking the general form of a basket. A base member 52 is integrally formed with the upright support 51, and a pair of bayonet connectors 53 project downwardly into releasable mounting engagement with openings 25 in base plate 20.

Figure 4:
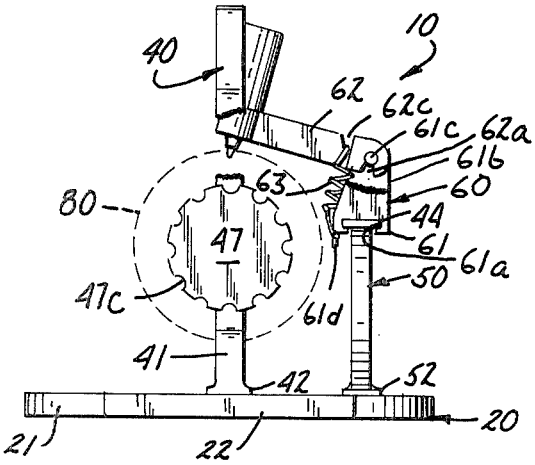
FIG. 4 is an end view of the egg decorating device showing in particular the relationship of the egg marker to the egg.
Figure 6:
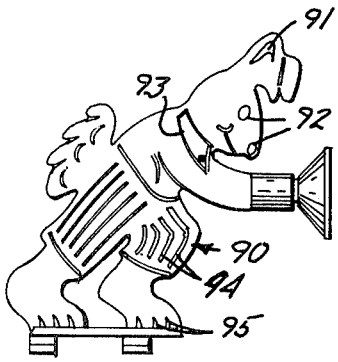
FIG. 6 is a view in side elevation of an alternative embodiment of one of the upright standards for the egg decorating machine.

Also integrally formed with upright support 51 is a horizontal track 54. Track 54 has a flat top surface and a thin, rectangular cross section. As shown in FIG. 4, the side edges of track 54 extend laterally of the support 51, and the track ends also project longitudinally beyond the support 51 (FIG. 3).

Track follower 60 comprises a body 61 having an opening 61*a* sized for sliding engagement with the track 54. As constructed, the horizontal track 54 and track following body 61 are interlockably constructed, which permits longitudinal sliding movement of the body 61 relative to the track 54, while at the same time resisting forces acting on the body 61 as the egg is marked. Body 61 defines upright opposed sides 61*b* between which an arm 62 is pivotally connected. This pivotal connection is accomplished by a pair of bosses 61*c* extending inwardly from each of the upright sides 61*b*. The inward end of arm 62 is formed with axial openings mating with the bosses 61*c*. Access is given to the axial openings by a wedge-shaped passage 62*a* (FIG. 4), thus permitting the arm 62 to be snapped over the bosses 61*c* in pivotal relation.

The opposite end of arm 62 is bifurcated, defining resilient circular segments 62*b* which are sized to receive the cylindrical shank of the marker 70. This construction is such that markers of different colors may be easily snapped into position and interchanged.

Arm 62 also includes a notch 62*c* formed in its upper edge which receives one end of a coil spring 63. The opposite end of spring 63 is connected to a stud 61*d* that projects downwardly from the bottom of body 61, so that arm 62 is normally urged downward to effect engagement of the marker 70 with the egg 80.

Assembly of the device 10 is accomplished simply by mounting each of the upright standards 30, 40 to the base plate 20 by the bayonet mounting structure described above. It will be noted in this regard that presence of an egg in the decorating position urges each of the standards 30, 40 away from each other and into the locking position. The track member 50 is similarly mounted with its bayonet structure.

The arm 62 is snapped onto the bosses 61*c*, and the spring 63 is placed between the stud 61*d* and notch 62*c*. The track follower 60 is now in its assembled state, and may be slidably mounted on the track 54.

Operation of the egg decorating device 10 begins with retraction of the handle wheel 47 and placement of an egg 80 between the cup-shaped members 34, 35. A marker 70 of a desired color is then inserted into the end of arm 62 so that the marker tip engages the egg under the influence of spring 63. The user may now decoratively mark the egg by grasping the track following member 60 and causing it to move back and forth along the track 54, which causes a longitudinal decorative mark to be made on the egg 80, by rotating the handle wheel 47, which causes the egg 80 to rotate relative to the marker 70 and causes a circumferential mark to be made on the egg 80, or by combining these two manipulations, which results in endless variations of decorative patterns on the egg 80.

Because the arm 62 is capable of pivotal movement toward and away from the longitudinal axis of the egg, the marker 70 is always in engagement with the egg surface as the track follower 60 is moved along the track 54.

Although the track 54 is preferably straight and flat, which is structurally more simple and easier to use, it could be arcuately shaped in conformance to the egg surface. Further, although the track marker 50 operates in a fixed position in the preferred embodiment, it is possible for the track member to be mounted to the base plate 20 for pivotal movement about a vertical axis, which would result in diagonal configurations on the egg surface.

Preferably, the device 10 is capable of decoration, which increases the enjoyment by the user. To this end, an adhesively backed cutout 35 depicting clothing for the rabbit body 31 is provided. Similar cutouts 49*a*, 49*b* are provided for the rabbit body 41. Cutouts of identical shapes, but of varying patterns and colors may also be provided, permitting selection by the user of the manner in which the rabbits are dressed. similar in shape to the upright standard 30, but which is formed with various recessed lines and shapes which may easily be colored with the use of the marking devices 70. The upright standard 90 includes an irregular recess 91 depicting a portion of the rabbit's ear, irregular recesses 92 depicting the facial features of the rabbit, and irregular recess 93 representing the rabbit's shirt collar, a plurality of longitudinal grooves 94 depicting trousers and irregular recesses 95 for the rabbit's toes.

Such decorative grooves and recesses may be included on both upright standards, the track member and base plate as well.

What is claimed is:

1. An egg decorating device, comprising:

(a) a substantially flat base;

(b) egg holding means carried by the case for releasably holding an egg for rotation about a longitudinal axis comprising (i) first and second upright standards disposed in opposed, spaced relation;

(ii) an egg receiving member carried by each standard for rotation about said longitudinal axis, each member constructed to receive one end of an egg; and (iii) one of said egg receiving members being mounted for retractable movement relative to the other on said longitudinal axis to permit entry of an egg therebetween;

(c) an upright track support disposed on the base in spaced relation to the longitudinal axis;

(d) an elongated track member defining first and second free ends and carried by the track support in substantial alignment with the longitudinal axis;

(e) bayonet means for interlockably and releasably connecting each of said first and second upright standards and said upright track support to the flat base, the bayonet means for the first and second upright standards being so constructed that said standards are interlocked with the base when they are urged away from each other and released when urged toward each other;

(f) a track following member constructed to be manually moved longitudinally along the track means;

an arm member pivotally carried by the track following member for swinging movement toward and away from an egg carried by the egg holding means, the arm member including means for carrying an egg marking device;

(g) biasing means for urging the arm member into engagement with an egg mounted in the egg holding means; and (h) the track member and track following member having interlocking means so that the track following member can be slidably mounted thereon or removed from either of said first and second free ends, and to permit said longitudinal sliding movement while resisting forces acting on the track following member as the egg is marked.

2. The device defined by claim 1, wherein the bayonet means comprises:

(a) a pair of longitudinally aligned bayonet openings formed in the base for each of said first and second upright standards and the upright track support;

(b) and a pair of bayonet members projecting downwardly from each of said first and second upright standards and said upright track support for registration with the associated bayonet openings.

3. The device defined by claim 1, wherein the arm member is releasably connected to the track following member.

4. The device defined by claim 1, which further comprises means for urging said one egg holding member toward the other.

5. The device defined by claim 4, wherein said one egg receiving member comprises an elongated thin shaft that is carried for longitudinal movement along said longitudinal axis by the associated upright standard, and a cup-shaped member mounted at one end of the shaft.

6. The device defined by claim 5, wherein the elongated shaft projects entirely through said upright standard, and further comprises a handle wheel mounted on the opposite end of the shaft to permit manual rotation thereof.

7. The device defined by claim 6, wherein the biasing means comprises a spring encircling the elongated thin shaft.

8. The device defined by claim 4, wherein each of the egg receiving members is cup shaped.

9. The device defined by claim 1, wherein each of said first and second standards is configured in the shape of a rabbit body, and each defines forepaws by which the egg receiving members are carried.

10. The device defined by claim 9, and further comprising adhesively backed cutout members depicting clothing for the rabbit body which may be selectively placed thereon by the user for decorative purposes.

11. The device defined by claim 9, wherein each of said rabbit bodies defines an outer surface, and further comprising configurations recessed in said outer surfaces to depict features and clothing for the rabbit, said recessed configurations being selectively markable by the user for decorative purposes.

12. The device defined by claim 1, wherein each of said first and second free ends of the elongated track member extends longitudinally beyond the track support.

13. The device defined by claim 1, wherein:

(a) the track has a thin, rectangular cross-section with side edges that extend laterally of the track support, and the track defining a flat-top surface; and (b) the track-following member defines a rectangular opening sized to be received by the track in sliding engagement therewith.

14. The device defined by claim 1, wherein the upright track support is pivotally mounted to the base for adjustable movement about an axis transverse to said longitudinal axis.

15. The device defined by claim 1, wherein the means for carrying an egg marking device is constructed to releasably hold the marking device to permit removal and replacement thereof.

* * * * *

UNITED STATES PATENT AND TRADEMARK OFFICE

CERTIFICATE OF CORRECTION

PATENT NO. : 4,185,389

DATED : January 29, 1980

INVENTOR(S) : Stanley J. Fudro

It is certified that error appears in the above-identified patent and that said Letters Patent are hereby corrected as shown below:

Column 5, line 43, "substantial" should be changed to --substantially parallel--.

Signed and Sealed this

*Third* Day of *June 1980*

[SEAL]

*Attest:*

SIDNEY A. DIAMOND

*Attesting Officer*

*Commissioner of Patents and Trademarks*